US008177532B2

(12) United States Patent
Okaichi et al.

(10) Patent No.: US 8,177,532 B2
(45) Date of Patent: May 15, 2012

(54) EXPANDER AND EXPANDER-COMPRESSOR UNIT

(75) Inventors: Atsuo Okaichi, Osaka (JP); Yasufumi Takahashi, Osaka (JP); Hiroshi Hasegawa, Osaka (JP); Masaru Matsui, Kyoto (JP); Takeshi Ogata, Osaka (JP); Masanobu Wada, Osaka (JP)

(73) Assignee: Panasonic Corporation, Osaka (JP)

( * ) Notice: Subject to any disclaimer, the term of this patent is extended or adjusted under 35 U.S.C. 154(b) by 612 days.

(21) Appl. No.: 12/302,151

(22) PCT Filed: Apr. 24, 2007

(86) PCT No.: PCT/JP2007/058866

§ 371 (c)(1),
(2), (4) Date: May 21, 2009

(87) PCT Pub. No.: WO2007/138809

PCT Pub. Date: Dec. 6, 2007

(65) Prior Publication Data

US 2009/0297382 A1 Dec. 3, 2009

(30) Foreign Application Priority Data

May 26, 2006 (JP) ..... 2006-147118

(51) Int. Cl.
*F01C 3/00* (2006.01)
*F03C 2/00* (2006.01)
*F04C 18/00* (2006.01)

(52) U.S. Cl. ..... 418/3; 418/11; 418/60; 418/55.6; 418/94; 418/102

(58) Field of Classification Search ..... 418/3, 11, 418/58, 60, 55.1–55.6, 57, 94, 102, 88, 270
See application file for complete search history.

(56) References Cited

U.S. PATENT DOCUMENTS

| | | | | |
|---|---|---|---|---|
| 2,130,349 | A | 9/1938 | Kucher | |
| 5,212,964 | A | 5/1993 | Utter et al. | |
| 7,419,369 | B2 * | 9/2008 | Sakitani et al. | 418/3 |
| 2006/0165542 | A1 * | 7/2006 | Sakitani et al. | 418/3 |

FOREIGN PATENT DOCUMENTS

| | | | |
|---|---|---|---|
| EP | 1 669 542 | A1 | 6/2006 |
| JP | 62-077562 | A | 4/1987 |
| JP | 3-117692 | A | 5/1991 |
| JP | 4-101089 | A | 4/1992 |
| JP | 8-028461 | A | 1/1996 |
| JP | 2000-073974 | A | 3/2000 |
| JP | 2000-97185 | | 4/2000 |
| JP | 2001-165040 | A | 6/2001 |
| JP | 2004-100608 | A | 4/2004 |
| JP | 3674625 | B2 | 5/2005 |

* cited by examiner

*Primary Examiner* — Theresa Trieu
(74) *Attorney, Agent, or Firm* — Hamre, Schumann, Mueller & Larson, P.C.

(57) ABSTRACT

The expander-compressor unit 70 includes the closed casing 1, the expansion mechanism 4 disposed in the closed casing 1 so that a surrounding space thereof is filled with the oil, the compression mechanism 2 disposed in the closed casing 1 so as to be positioned higher than the oil level, the shaft 5 for coupling the compression mechanism and the expansion mechanism 4 to each other, and the oil flow suppressing member 50 disposed in the surrounding space of the expansion mechanism 4 so that the space 55*a* filled with the oil is formed between the expansion mechanism 4 and the oil flow suppressing member 50. Thereby the flow of the oil filling the inner reserving space 55*a* is suppressed, and thus, heat transfer from the high temperature oil to the low temperature expansion mechanism can be reduced.

16 Claims, 10 Drawing Sheets

A-A

B-B

EXPANDER AND EXPANDER-COMPRESSOR UNIT

TECHNICAL FIELD

The present invention relates to an expander for expanding fluid. The present invention also relates to an expander-compressor unit having an integral construction in which a compression mechanism for compressing fluid and an expansion mechanism for expanding fluid are coupled to each other by a shaft.

BACKGROUND ART

Apparatuses, so-called refrigeration cycle apparatuses, utilizing a refrigeration cycle of a refrigerant, i.e., compressing, radiating, expanding, and vaporizing, are used for a variety of applications, such as air conditioners and water heaters. As an expander-compressor unit used for such refrigeration cycle apparatuses, there can be mentioned a unit designed for improving efficiency of the refrigeration cycle by coupling, with a shaft, an expansion mechanism that converts the expansion energy generated during the expansion of refrigerant under reduced pressure into mechanical energy and recovers the resulting mechanical energy, and a compression mechanism that compresses the refrigerant, and by supplying the mechanical energy recovered by the expansion mechanism to the compression mechanism (JP 62(1987)-77562 A).

Since the compression mechanism adiabatically compresses the refrigerant, the temperatures of the components of the compression mechanism rises in accordance with the temperature of the refrigerant. On the other hand, the temperatures of the components of the expansion mechanism lower in accordance with the temperature of the refrigerant because the refrigerant cooled with a radiator flows into the expansion mechanism and is expanded adiabatically. Thus, mere integration of the compression mechanism and the expansion mechanism as described in JP 62 (1987)-77562 A unfavorably allows the heat on the compression mechanism side to transfer to the expansion mechanism side. Such a heat transfer means that unintended heating of the refrigerant will occur at the expansion mechanism as well as that unintended cooling of the refrigerant will occur at the compression mechanism, leading to a reduced efficiency of the refrigeration cycle.

In order to solve this problem, it has been a proposal to provide a heat insulating member between the compression mechanism and the expansion mechanism so as to block the heat transfer from the compression mechanism to the expansion mechanism (JP 2001-165040 A). Furthermore, it has been proposed to dispose, as shown in FIG. 10, a compression mechanism 102, a motor 103, and an expansion mechanism 104 in a closed casing 101 in this order from the bottom, while providing a heat insulating member 105 on a surface of the expansion mechanism 104 so as to block the heat transfer from the surrounding refrigerant (JP 3674625 B).

DISCLOSURE OF INVENTION

Using the heat insulating members as described in JP 2001-165040 A and JP 3674625 B is an option. When a rotary-type mechanism is used, however, it is preferable that the surrounding space thereof is filled with oil in order to prevent leakage of the refrigerant, especially leakage of the refrigerant from a vane, or in order to ease the lubrication on each of sliding parts. Therefore, it is difficult to employ a layout in which the scroll-type compression mechanism is located at a lower position and the rotary-type expansion mechanism is located at an upper position. Even if such a layout can be employed, problems of the refrigerant leakage and lubrication failure will arise shortly.

An object of the present invention is to provide an expander and an expander-compressor unit capable of improving performance of a refrigeration cycle apparatus by suppressing heat transfer from the oil to the expansion mechanism even when the expansion mechanism is used while being immersed in the oil.

Accordingly, the present invention provides an expander-compressor unit including:

a closed casing having a bottom portion utilized as an oil reservoir;

an expansion mechanism disposed in the closed casing in such a manner that a surrounding space thereof is filled with oil;

a compression mechanism disposed in the closed casing in such a manner that the compression mechanism is positioned higher than an oil level;

a shaft for coupling the compression mechanism and the expansion mechanism to each other; and an oil flow suppressing member that is disposed in the surrounding space of the expansion mechanism and divides an oil reserving space between the closed casing and the expansion mechanism into an inner reserving space and an outer reserving space for suppressing a flow of the oil filling the inner reserving space more strongly than a flow of the oil filling the outer reserving space, the inner reserving space being a space between the oil flow suppressing member and the expansion mechanism while the outer reserving space being a space between the oil flow suppressing member and the closed casing.

In another aspect, the present invention provides an expander including:

a closed casing having a bottom portion utilized as an oil reservoir;

an expansion mechanism disposed in the closed casing in such a manner that a surrounding space thereof is filled with oil; and an oil flow suppressing member that is disposed in the surrounding space of the expansion mechanism and divides an oil reserving space between the closed casing and the expansion mechanism into an inner reserving space and an outer reserving space for suppressing a flow of the oil filling the inner reserving space more strongly than a flow of the oil filling the outer reserving space, the inner reserving space being a space between the oil flow suppressing member and the expansion mechanism and the outer reserving space being a space between the oil flow suppressing member and the closed casing.

Generally, the heat transfer coefficient between fluid and solid is increased when the fluid flows faster. Accordingly, the heat transfer from the oil to the expansion mechanism can be prevented by suppressing the oil flow. In the aforementioned expander-compressor unit of the present invention, the oil flow suppressing member suppresses the flow of the oil filling the space between the oil flow suppressing member and the expansion mechanism (the inner reserving space), allowing the heat transfer from the high temperature oil to the low temperature expansion mechanism to be reduced. More specifically, heat flux from the oil to the expansion mechanism is reduced, and heating of the expansion mechanism and also cooling of the compression mechanism by the oil are prevented. Thus, when used for a refrigeration cycle apparatus, the expander-compressor unit of the present invention will demonstrate excellent refrigerating capacity by preventing an increase in enthalpy of the expanded refrigerant. At the same time, it will demonstrate excellent heating capacity by preventing a reduction in enthalpy of the compressed refrigerant. As a result, a refrigeration cycle apparatus with high COP (coefficient of performance) can be realized.

These effects also can be obtained in the case of an independent expander.

BEST MODE FOR CARRYING OUT THE INVENTION

Figure 1:
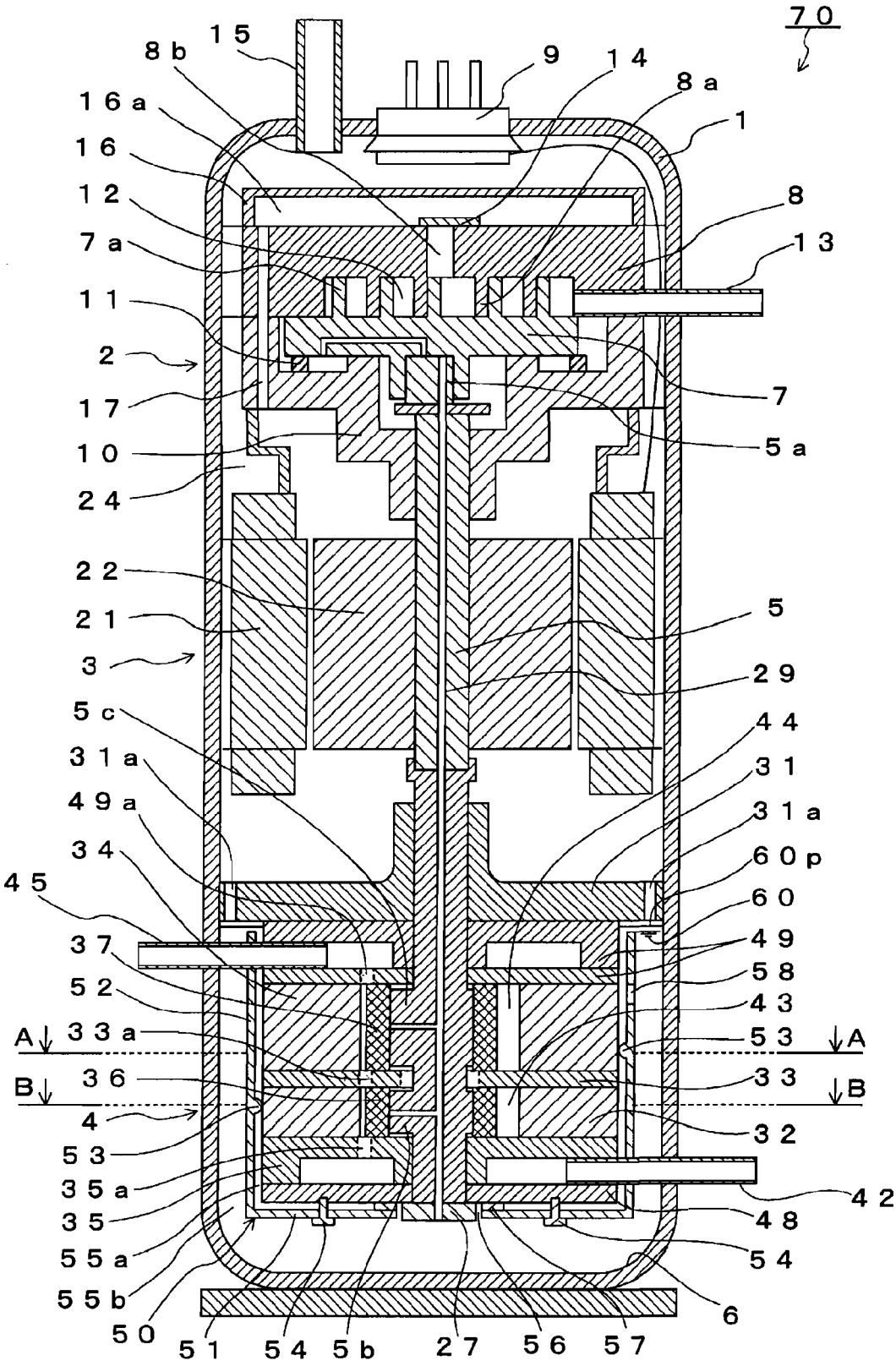
FIG. 1 is a vertical cross-sectional view of an expander-compressor unit according to a first embodiment of the present invention.

Hereinbelow, embodiments of the present invention will be described with reference to the accompanying drawings. As shown in FIG. 1, an expander-compressor unit 70 is provided with a closed casing 1, a positive displacement compression mechanism 2 disposed in the closed casing 1, a positive displacement expansion mechanism 4 also disposed in the closed casing 1, a shaft 5 having one end connected to the compression mechanism 2 and another end connected to the expansion mechanism 4, and a motor 3 disposed between the compression mechanism 2 and the expansion mechanism 4. The shaft 5 couples the compression mechanism 2 to the expansion mechanism 4. The motor 3 drives the shaft 5 rotationally. A terminal 9 for supplying electric power to the motor 3 is attached to the top of the closed casing 1. The expansion mechanism 4 converts the expansion force generated during the expansion of the refrigerant (working fluid) into torque, and gives the torque to the shaft 5 to assist the rotational driving of the shaft 5 by the motor 3. More specifically, an expansion energy of the refrigerant is recovered by the expansion mechanism 4, and the recovered energy is superimposed on the force of the motor 3 driving the compression mechanism 2.

A bottom portion of the closed casing 1 is used as an oil reservoir 6 in which oil 60 (refrigeration oil) for lubricating and sealing each of the mechanisms 2 and 4 is held. When the orientation of the closed casing 1 is determined so that an axial direction of the shaft 5 is parallel to a vertical direction and the oil reservoir 6 is located on a bottom side, the compression mechanism 2, the motor 3, and the expansion mechanism 4 are arranged in this order from a top in the closed casing 1. Accordingly, a surrounding space of the expansion mechanism 4 is filled with the oil 60. In other words, a sufficient amount of the oil 60 to fill the surrounding space of the expansion mechanism 4 is held in the oil reservoir 6.

An oil flow suppressing member 50 is disposed in the surrounding space of the expansion mechanism 4. The oil flow suppressing member divides an oil reserving space formed between the closed casing 1 and the expansion mechanism 4 into an inner reserving space 55*a*, which is a space between the oil flow suppressing member 50 and the expansion mechanism 4, and an outer reserving space 55*b*, which is a space between the oil flow suppressing member 50 and the closed casing 1. Consequently, a flow of the oil 60 filling the inner reserving space 55*a* is suppressed more strongly than a flow of the oil 60 filling the outer reserving space 55*b*. When the flow of the oil 60 filling the surrounding space of the expansion mechanism 4 can be suppressed, the heat transfer coefficient between the oil 60 and the expansion mechanism 4 can be reduced, and the heat transfer from the oil 60 to the expansion mechanism 4 can be suppressed accordingly.

The oil flow suppressing member 50 includes a tubular portion 52 shaped to extend along an outline of the expansion mechanism 4. The inner reserving space 55*a* and the outer reserving space 55*b* are formed by surrounding the expansion mechanism 4 with the tubular portion 52. With the tubular portion 52 thus configured, the oil flow suppressing member 50 can surround the expansion mechanism 4 on 360°, making it possible to separate the inner reserving space 55*a* from the outer reserving space 55*b* in a reliable manner.

Specifically, the flow suppressing member 50 is constituted by a closed-bottomed tubular vessel (cup) shaped to extend along the outline of the expansion mechanism 4. The presence of a bottom portion 51 can prevent the oil 60 cooled in the inner reserving space 55*a* from flowing out from the underside. Moreover, the flow suppressing member 50 constituted by the closed-bottomed tubular vessel can be attached to the expansion mechanism 4 very easily. However, the oil flow suppressing member 50 does not necessarily have to be a closed-bottomed tubular vessel. As will be described later in the second embodiment, a circular cylindrical oil flow suppressing member without a bottom also can be employed suitably. In the present embodiment, the tubular portion 52 has a circular cylindrical shape whose horizontal cross section perpendicularly intersecting with the axial direction of the shaft 5 appears to be round. It is also possible, however, to adopt a shape other than a circular cylindrical shape, for example, a rectangular tubular shape in which the aforementioned horizontal cross section appears to be rectangular.

The compression mechanism 2 and the expansion mechanism 4 will be described briefly below.

The scroll-type compressor mechanism 2 has an orbiting scroll 7, a stationary scroll 8, an Oldham ring 11, a bearing member 10, a muffler 16, a suction pipe 13, and a discharge pipe 15. The orbiting scroll 7 is fitted to an eccentric portion 5*a* of the shaft 5, and its self-rotation is restrained by the Oldham ring 11. The orbiting scroll 7, with a spiral shaped lap 7*a* thereof meshing with a lap 8*a* of the stationary scroll 8, scrolls in association with rotation of the shaft 5. A crescent-shaped working chamber 12 formed between the laps 7*a* and 8*a* reduces its volumetric capacity as it moves from outside to inside, compressing the refrigerant drawn from the suction pipe 13. The compressed refrigerant presses and opens a lead valve 14 and passes through a discharge port 8*b* formed at the center of the stationary scroll 8, an internal space 16*a* of the muffler 16, and a flow passage 17 penetrating through the stationary scroll 8 and the bearing member 10, in that order. The refrigerant then is discharged to an internal space 24*a* of the closed casing 1. The oil 60 that has reached the compression mechanism 2 via an oil supply passage 29 in the shaft 5 lubricates the sliding surfaces between the orbiting scroll 7 and the eccentric portion 5*a* and the sliding surfaces between the orbiting scroll 7 and the stationary scroll 8. The refrigerant that has been discharged in the internal space 24 of the closed casing 1 is separated from the oil 60 by a gravitational force or a centrifugal force while it remains in the internal space 24. Thereafter, the refrigerant is discharged from the discharge pipe 15 to a gas cooler.

The motor 3 for driving the compression mechanism 2 via the shaft 5 includes a stator 21 fixed to the closed casing 1 and a rotor 22 fixed to the shaft 5. Electric power is supplied from the terminal 9 disposed at the top of the closed casing 1 to the motor 3. The motor 3 may be either a synchronous motor or an induction motor. The motor 3 is cooled by the refrigerant discharged from the compression mechanism 2 and the oil 60 mixed in the refrigerant.

The shaft 5 may be formed with a plurality of components mutually coupled as in the present embodiment, or may be formed with a single component without a coupling portion. The oil supply passage 29 for supplying the oil 60 to the compression mechanism 2 and the expansion mechanism 4 is formed in the shaft 5 in such a manner that the oil supply passage 29 extends in the axial direction thereof. An oil pump 27 is attached to a lower end portion of the shaft 5. A through hole 56 is formed in the bottom portion 51 of the oil flow suppressing member 50. The oil pump 27 feeds the oil 60 into the oil supply passage 29 through the through hole 56. The lower end portion of the shaft 5 may protrude from the through hole 56 in the bottom portion 51 of the oil flow suppressing member 50, and the oil pump 27 may be attached to the protruding lower end portion.

Figure 2A:
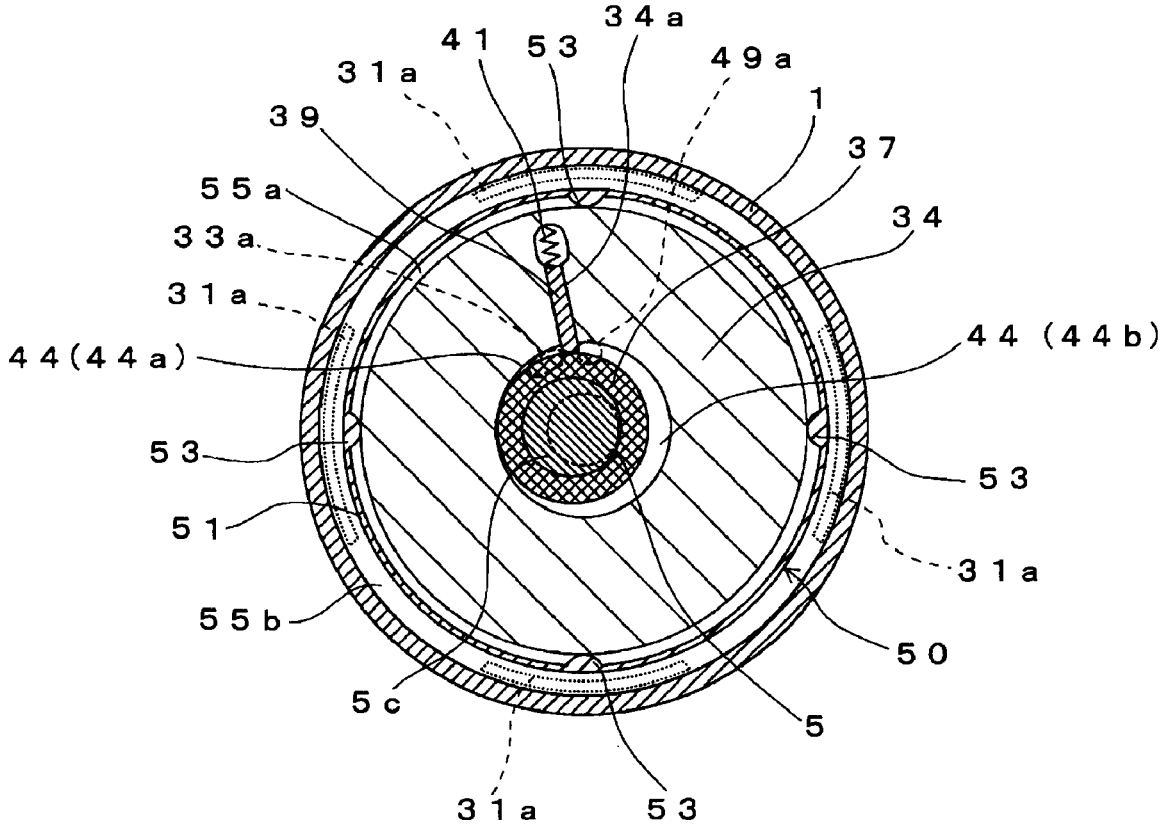
FIG. 2A is a transverse cross-sectional view taken along the line A-A in FIG. 1.
Figure 2B:
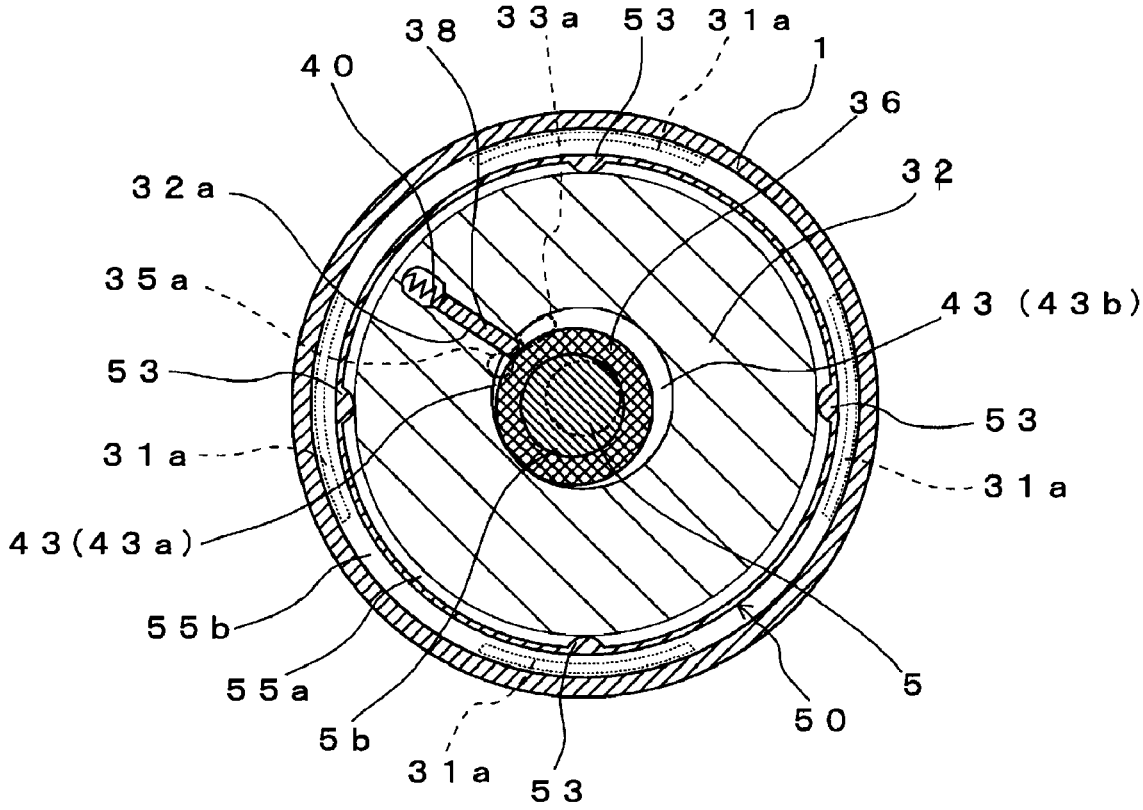
FIG. 2B is a transverse cross-sectional view taken along the line B-B in FIG. 1.

FIG. 2A and FIG. 2B show cross-sectional views of the expansion mechanism 4. As shown in FIG. 1, FIG. 2A, and FIG. 2B, the two-stage rotary-type expansion mechanism 4 includes a sealing plate 48, a lower bearing member 35, a first cylinder 32, an intermediate plate 33, a second cylinder 34, a second muffler 49, an upper bearing member 31, a first roller (first piston) 36, a second roller (second piston) 37, a first vane 38, a second vane 39, a first spring 40, and a second spring 41.

As shown in FIG. 1, the first cylinder 32 is fixed, via the lower bearing member 35, to an upper portion of the sealing plate 48 supporting the shaft 5. The intermediate plate 33 is fixed to an upper portion of the first cylinder 32, and the second cylinder 34 is fixed to an upper portion of the intermediate plate 33. The first roller 36 is disposed in the first cylinder 32 and is fitted rotatably to a first eccentric portion 5*b* of the shaft 5. The second roller 37 is disposed in the second cylinder 34 and is fitted rotatably to a second eccentric portion 5*c* of the shaft 5. As shown in FIG. 2B, the first vane 38 is disposed slidably in a vane groove 32*a* formed in the first cylinder 32. As shown in FIG. 2A, the second vane 39 is disposed slidably in a vane groove 34*a* of the second cylinder 34. The first vane 38 is pressed against the first roller 36 by the first spring 40. The first vane 38 partitions a space 43 between the first cylinder 32 and the first roller 36 into a suction side space 43*a* and a discharge side space 43*b*. The second vane 39 is pressed against the second roller 37 by the second spring 41. The second vane 39 partitions a space 44 between the second cylinder 34 and the second roller 37 into a suction side space 44*a* and a discharge side space 44*b*. A communication port 33*a* is formed in the intermediate plate 33. The communication port allows the discharge side space 43*b* of the first cylinder 32 and the suction side space 44*a* of the second cylinder 34 to communicate with each other so as to form an expansion chamber by the two spaces 43*b* and 44*a*.

The refrigerant drawn from a suction pipe 42 to the expansion mechanism 4 is guided to the suction side space 43*a* of the first cylinder 32 via a suction port 35*a* formed in the lower bearing member 35. As the shaft 5 rotates, the suction side space 43*a* of the first cylinder 32 is moved out of communication with the suction port 35*a* and is changed into the discharge side space 43*b*. As the shaft 5 rotates further, the refrigerant that has moved to the discharge side space 43*b* of the first cylinder 32 is guided to the suction side space 44*a* of the second cylinder 34 via the communication port 33*a* of the intermediate plate 33. As the shaft 5 rotates further, the volumetric capacity of the suction side space 44*a* of the second cylinder 34 increases, while the volumetric capacity of the discharge side space 43*b* of the first cylinder 32 decreases. The refrigerant expands because the amount of the increase in volumetric capacity of the suction side space 44*a* of the second cylinder 34 is greater than the amount of the decrease in volumetric capacity of the discharge side space 43*b* of the first cylinder 32. At this time, the expansion force of the refrigerant is applied to the shaft 5, so the load on the motor 3 is reduced. As the shaft 5 rotates further, the discharge side space 43*b* of the first cylinder 32 and the suction side space 44*a* of the second cylinder 34 are moved out of communication with each other, and the suction side space 44*a* of the second cylinder 34 is changed into the discharge side space 44*b*. The refrigerant that has moved to the discharge side space 44*b* of the second cylinder 34 is discharged from a discharge pipe 45 via a discharge port 49*a* formed in the second muffler 49.

In the rotary-type expansion mechanism 4, it is necessary to lubricate a vane that partitions a space in the cylinder into two spaces due to its structural limitations. However, when the expansion mechanism 4 directly is immersed in the oil, the vane can be lubricated in a remarkably simple manner, specifically, by exposing a rear edge of the vane groove in which the vane is disposed, to the interior of the closed casing. In the present embodiment as well, the vanes 38 and 39 are lubricated in such a manner.

Figure 10:
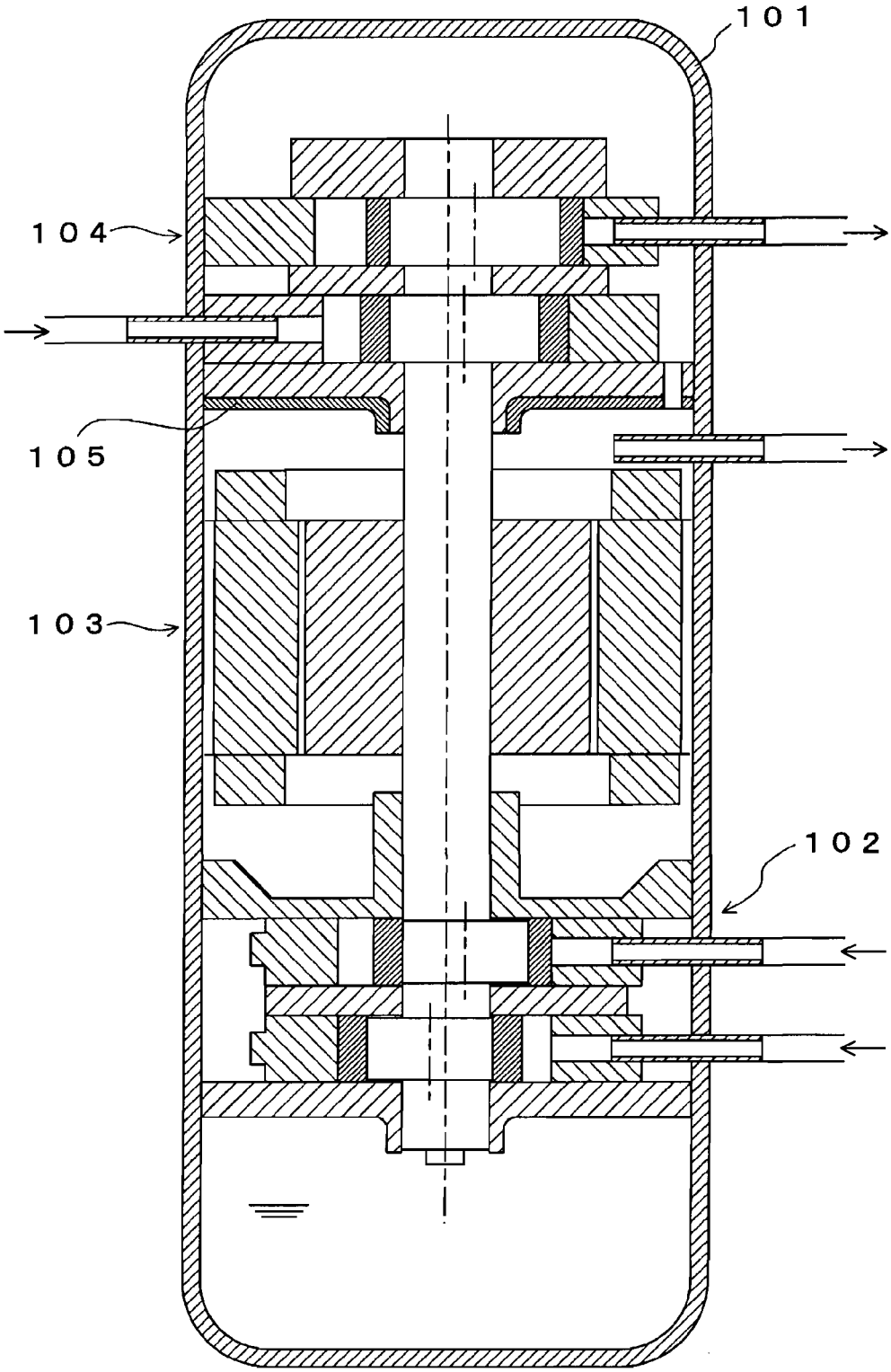
FIG.10 PRIOR ART
FIG. 10 is a vertical cross-sectional view of a conventional expander-compressor unit.

Lubrication of the vanes is somewhat difficult in the case that at least one of the compression mechanism and the expansion mechanism employs a rotary-type mechanism and the rotary-type mechanism employs a layout in which the mechanism is not immersed in oil (as in the structure of FIG. 10, for example). First, among the components of the rotary-type mechanism that require lubrication, the pistons and the cylinders can be lubricated relatively easily by using the oil supply passage formed in the shaft. However, this is not the case with the vanes. Since the vanes are away from the shaft, it is impossible to supply oil directly from the oil supply passage in the shaft to the vanes. For this reason, some kind of design scheme is necessary for sending the oil discharged from an upper end portion of the shaft to the vane grooves. Such a design scheme may be, for example, providing an oil supply pipe outside the cylinders separately, but it inevitably necessitates an increase of the parts count and complexity of the structure.

On the other hand, such a design scheme is essentially unnecessary in the case of a scroll-type mechanism, in which it is possible to distribute oil to all the parts requiring lubrication relatively easily. In view of such circumstances, it can be said that the layout in which the rotary-type mechanism is immersed in oil and the scroll-type mechanism is positioned higher than the oil level is one of the most desirable layouts. In order to realize such a layout, the present embodiment employs the following configuration. The compression mechanism 2 and the expansion mechanism 4 are a scroll-type mechanism and a rotary-type mechanism, respectively, and the compression mechanism 2, the motor 3, and the expansion mechanism 4 are disposed in this order along the axial direction of the shaft 5 in such a manner that the surrounding space of the rotary-type expansion mechanism 4 is filled with the oil 60.

Next, the oil flow suppressing member 50 will be described in detail.

As shown in FIG. 1, the oil flow suppressing member 50 is constituted by a vessel having the tubular portion 52 and the bottom portion 51, and is fixed to the expansion mechanism 4 using fastening parts 54, such as bolts and screws, in such a manner that the expansion mechanism 4 is covered by the oil flow suppressing member 50 from the lower end side of the shaft 5. In the present embodiment, the oil flow suppressing member 50 is fixed directly to the expansion mechanism 4. However, the relative position of the oil flow suppressing member 50 to the expansion mechanism 4 appropriately can be determined even when the oil flow suppressing member 50 is fixed to the closed casing 1 side.

Both of the inner reserving space 55*a* and the outer reserving space 55*b*, which are separated from each other by the oil flow suppressing member 50, are filled with the oil 60. The oil 60 filling the inner reserving space 55*a* is cooled by the expansion mechanism 4. Thus, an average temperature of the oil 60 filling the inner reserving space 55*a* becomes lower than an average temperature of the oil 60 filling the outer reserving space 55*b*.

The shape, size, and mounting location of the oil flow suppressing member 50 are determined in such a manner that the volume of the oil 60 filling the inner reserving space 55*a* becomes smaller than the volume of the oil 60 filling the outer reserving space 55*b*. In other words, the volumetric capacity of the inner reserving space 55*a* is smaller than the volumetric capacity of the outer reserving space 55*b*. Since the oil 60 filling the inner reserving space 55*a* is only used for lubricating and sealing the vanes 38 and 39 of the expansion mechanism 4, a small quantity thereof is sufficient. On the other hand, the oil 60 filling the outer reserving space 55*b* is preferably present in a large amount because a considerably large amount of the oil 60 is drawn by the oil pump 27 and sent to the oil supply passage 29 in the shaft 5.

Figure 3:
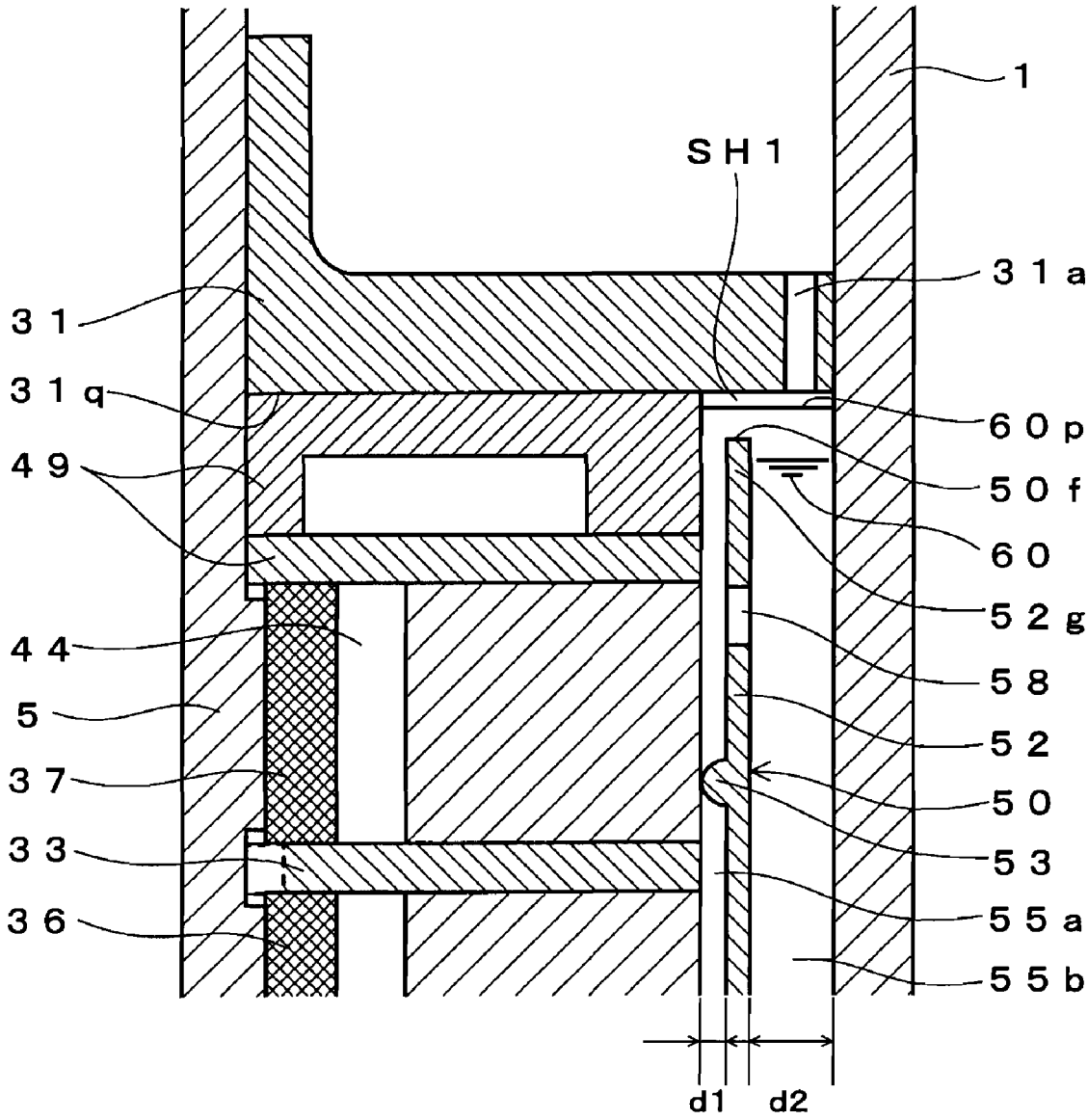
FIG. 3 is a partially enlarged view of FIG. 1.

While the shape and size of the oil flow suppressing member 50 depend on the design of the expansion mechanism 4, an average width d2 of the outer reserving space 55*b* is preferably larger than an average width d1 of the inner reserving space 55*a* with respect to a radial direction of the shaft 5, as shown in the partially enlarged view of FIG. 3. Such a configuration allows the oil 60 filling the inner reserving space 55*a* to have a volume sufficiently smaller than the volume of the oil 60 filling the inner reserving space 55*a*.

As shown in FIG. 1, the through hole 56 is formed in the bottom portion 51 of the oil flow suppressing member 50. The oil 60 can be fed into the oil supply passage 29 from the lower end portion of the shaft 5 via the through hole 56. The oil 60 to be fed into the oil supply passage 29 is a fraction of that filling the outer reserving space 55*b*. In a surrounding space of the through hole 56, the clearance between the bottom portion 51 and the expansion mechanism 4 is sealed with a ring-shaped sealant 57. Such a configuration forbids a flow of the oil 60 between the inner reserving space 55*a* and the outer reserving space 55*b* via the through hole 56. More specifically, the sealant 57 prevents the low temperature oil 60 filling the inner reserving space 55*a* from being mixed with the high temperature oil 60 filling the outer reserving space 55*b* via the through hole 56. As a result, the oil 60 having a relatively low temperature will continue to stay in the inner reserving space 55*a*, suppressing the heat transfer from the oil 60 to the expansion mechanism 4.

As shown in the partially enlarged view of FIG. 3, the oil flow suppressing member 50 has an opening portion 52*g* located on a side opposite to the bottom portion 51. The opening portion 52*g* is spaced apart from both an outer peripheral face of the expansion mechanism 4 and an underface 31*q* of the upper bearing member 31. That is, the height of the tubular portion 52 is adjusted so that a certain space (a clearance SH1) is ensured between an opening end face 50*f* of the oil flow suppressing member 50 and the underface 31*q* of the upper bearing member 31. The oil 60 is allowed to flow from the outer reserving space 55*b* into the inner reserving space 55*a* via the clearance SH1 formed to be positioned higher than the upper end 52*g* (the opening portion 52*g*) of the tubular portion 52. Such a configuration makes it possible to supply only the oil 60 leaking from a gap between the vane 38 and the vane groove 32*a* and a gap between the vane 39 and the vane groove 34*a* into the interior of the expansion mechanism 4, that is, only a minimum amount of the oil 60 needed, from the outer reserving space 55*b* to the inner reserving space 55*a*. Thus, an unnecessary flow of the oil 60 can be blocked.

The aforementioned clearance SH1 is formed along an entire circumference of the opening portion 52*g* of the oil flow suppressing member 50. Accordingly, the oil 60 is allowed to flow into the inner reserving space 55*a* from any angle throughout 360°. It may seem to be preferable to limit the area from which the oil 60 can flow into the inner reserving space 55*a*. In that case, however, the oil 60 will flow into the inner reserving space 55*a* with a strong momentum because the clearance SH1 is not so large, reducing the effect of suppressing the oil flow. When the oil 60 slowly flows into the inner reserving space 55*a* from the entire circumference of 360° as in the present embodiment, the flow of the oil 60 filling the inner reserving space 55*a* is suppressed more effectively, and an increase in heat transfer coefficient in accordance with an increase in flow rate can be prevented more effectively.

As shown in FIG. 1 and FIG. 3, the expander-compressor unit 70 of the present embodiment includes oil return passages 31*a* for returning, to the outer reserving space 55*b*, the oil 60 having been supplied from the outer reserving space 55*b* to the compression mechanism 2 through the oil supply passage 29 in the shaft 5 and having been used for lubricating the compression mechanism 2, the excess oil 60 that overflowed from an upper end portion of the oil supply passage 29, and the oil 60 separated from the compressed refrigerant, using the self weight of each of the oils 60, respectively. The oil 60 flowing through the oil return passage 31*a* is allowed to proceed into the outer reserving space 55*b*. This helps the oil 60 filling the inner reserving space 55*a* to avoid being directly mixed with the oil 60 returning from an upper side as well as to avoid being subject to a stirring effect.

In the present embodiment, a plurality of oil return ports 31*a* formed in the upper bearing member 31 are employed as the oil return passages 31*a*. The upper bearing member 31 is fixed, between the motor 3 and the expansion mechanism 4, to the closed casing 1 without a gap. Essentially, the oil return ports 31*a* are the only passage through which spaces above and under the upper bearing member 31 communicate with each other.

The positional relationship between the oil return ports 31*a* and the oil flow suppressing member 50 is important because the effect of suppressing the heat transfer from the oil 60 to the expansion mechanism 4 varies depending on whether the oil 60 flowing through the oil return ports 31*a* is guided to the inner reserving space 55*a* first, or to the outer reserving space 55*b*. Specifically, when the oil return ports 31*a* open toward the outer reserving space 55*b* as shown in the transverse cross-sectional views of FIG. 2A and FIG. 2B, it is possible to prevent the oil 60 having a relatively high temperature from flowing straight down into the inner reserving space 55*a*. At the same time, the flow of the oil 60 filling the inner reserving space 55*a* can be kept limited.

More specifically, when a bottom side opening of each of the oil return ports 31*a* is projected in a downward direction parallel to the axial direction of the shaft 5, the projected image of the opening entirely falls between an outer edge of the opening end face 50*f* of the oil flow suppressing member 50 and an inner peripheral face of the closed casing 1.

The tubular portion 52 of the oil flow suppressing member 50 has convex spacer portions 53 on a side of an inner peripheral face thereof facing the expansion mechanism 4. The spacer portions 53 protrude toward an outer peripheral face of the expansion mechanism 4. The spacer portions 53 prevent the oil flow suppressing member 50 from contacting closely with the expansion mechanism 4, and thereby the inner reserving space 55*a* is ensured around the entire circumference of the expansion mechanism 4. Accordingly, the inner reserving space 55*a* has a width determined by the protruding height of the spacer portions 53. Although the spacer portions 53 are integrally formed with the tubular portion 52 in the present embodiment, it is possible to use a spacer portion independent from the vessel constituting the oil flow suppressing member 50.

As shown in FIG. 2A and FIG. 2B, each of the spacer portions 53 has a tip portion on a side contacting the expansion mechanism 4, and a base-side portion on a side opposite to the side contacting the expansion mechanism 4. The tip portion is narrower than the base-side portion. Specifically, the surface contacting the expansion mechanism 4 is a curved surface protruding toward the expansion mechanism 4. An example of such a curved surface is a round surface. The spacer portions 53 thus configured tend to contact the expansion mechanism 4 at a point or a line. In such a case, a heat transfer channel created by the oil flow suppressing member 50 itself becomes narrower, and the heat resistance at the contact interface between the oil flow suppressing member 50 and the expansion mechanism 4 becomes higher. The higher heat resistance at the contact interface can suppress the heat transfer from the oil 60 filling the outer reserving space 55*b* to the expansion mechanism 4 through the oil flow suppressing member 50.

As shown in FIG. 3, the tubular portion 52 of the oil flow suppressing member 50 has a passage 58 that allows the oil 60 to flow between the inner reserving space 55*a* and the outer reserving space 55*b*. The passage 58 is formed at a position closer, with respect to the axial direction of the shaft 5, to the upper end 50*f* (the opening end face 50*f*) than the positions at which the vanes 38 and 39, lubrication-requiring components of the expansion mechanism 4, are disposed. In the present embodiment, an oil supply port 58 is employed as the passage 58. More specifically, the oil supply port 58 is formed to be positioned higher than an underface of the cylinder 34 (the second cylinder) closer to the compression mechanism 2, of the two cylinders 32 and 34 of the expansion mechanism 4. Since the oil supply port 58 is formed at such a position, the oil is supplied to the inner reserving space 55*a* through the oil supply port 58, and the vanes 38 and 39 and the vane grooves 32*a* and 34*a* of the expansion mechanism 4 can be lubricated in a reliable manner even if an oil level 60*p* becomes lower than the opening end face 50*f* of the oil flow suppressing member 50. Instead of the oil supply port 58, a slit may be formed in the tubular portion 52 of the oil flow suppressing member 50 in such a manner that the slit extends from the opening end face 50*f* toward the bottom portion 51.

Figure 4:
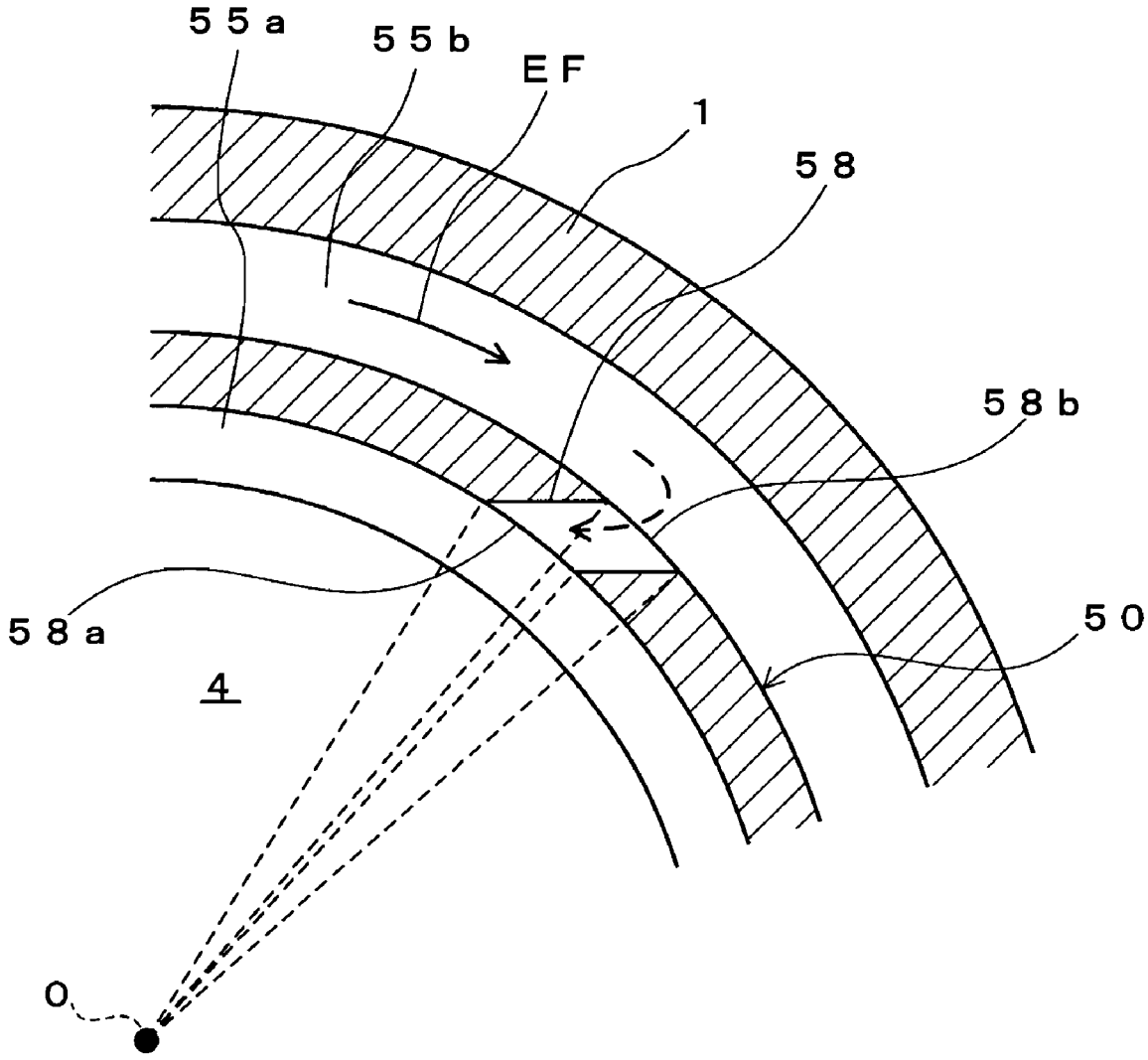
FIG. 4 is a schematic view for illustrating the working of an oil supply port of the oil flow suppressing member.

The oil supply port 58 may be formed in a straight direction toward a center of the shaft 5. The orientation thereof, however, is preferably adjusted as shown in the schematic view of FIG. 4 because of the following reason. The internal space 24 of the closed casing 1 apparently is divided into an upper portion and an lower portion with the upper bearing member 31. However, a revolving flow caused by the motor 4 affects the oil 60 held in the oil reservoir 6 through the oil return port 31*a*. In short, the oil 60 in the oil reservoir 6 tends to flow in the same rotational direction as that of the rotor 22 of the motor 4. This tendency is obvious especially in the oil 60 filling the outer reserving space 55*b* separated by the oil flow suppressing member 50. It is preferable that the oil 60 filling the inner reserving space 55*a* shows as little of such a tendency as possible. Therefore, the orientation of the oil supply port 58 preferably is adjusted so as to provide the oil 60 flowing from the outer reserving space 55*b* to the inner reserving space 55*a* through the oil supply port 58 with a flow in a rotational direction opposite to that of the rotor 22 of the motor 4, as shown in FIG. 4.

For example, in the case where the oil 60 filling the outer reserving space 55*b* forms a clockwise flow EF when viewed from the top with the shaft 5 being centered, the oil supply port 58 preferably has an outer opening end 58*b* further shifted clockwise than an inner opening end 58*a* that is closer to a center O of the shaft 5 when viewed from the top. More specifically, the outer opening end 58*b* is positioned on a downstream side of the rotational direction of the oil flow EF, while the inner opening end 58*a* is positioned on a upstream side. When the two opening ends 58*a* and 58*b* are in such a positional relationship, the oil 60 flowing from the outer reserving space 55*b* to the inner reserving space 55*a* through the oil supply port 58 once needs to flow in a direction opposite to that of the oil flow EF formed in the outer reserving space 55*b*. This prevents the oil flow EF in the outer reserving space 55*b* from affecting the inner reserving space 55*a*.

Figure 5:
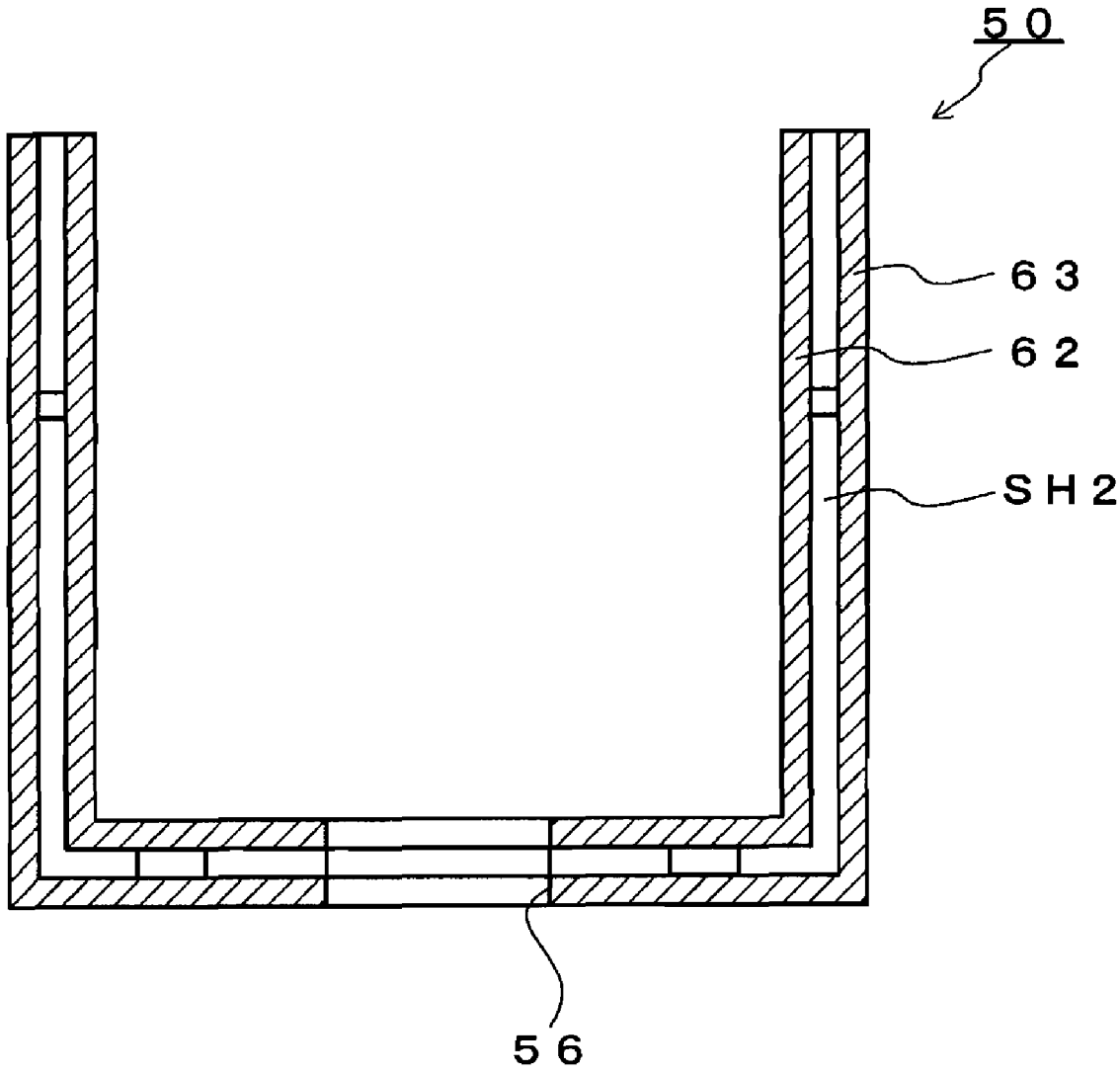
FIG. 5 is a vertical cross-sectional view of another example of a vessel constituting the oil flow suppressing member.

The closed-bottomed tubular vessel constituting the oil flow suppressing member 50 preferably includes a structure for improving heat insulation properties. Specifically, a hollow heat insulating structure can be employed as shown in the schematic sectional view of FIG. 5. A space SH2 between an inner vessel 62 and an outer vessel 63 reduces the amount of overall heat transfer from the outer reserving space 55*b* to the inner reserving space 55 via the oil flow suppressing member 50, contributing to the prevention of the heating of the expansion mechanism 4 and the prevention of the cooling of the compression mechanism 2 via the oil 60. The hollow heat insulating structure can be obtained by combining a plurality of vessels, that is, the inner vessel 62 and the outer vessel 63, that have been formed separately. Such an approach makes it possible to realize a complicated shape that cannot be produced by a one-time injection molding or press molding.

It should be noted that a closed-bottomed tubular vessel is used as the oil flow suppressing member 50 in the present embodiment. It is preferable to use a vessel with a shape flexibly adjusted according to the outline of the expansion mechanism 4, for example, a vessel with a mortar-like shape whose depth varies continuously or gradually.

The closed-bottomed tubular vessel constituting the oil flow suppressing member 50 may be composed of resin, metal, or ceramic, or may be composed of a combination of these materials.

Preferable examples of the resin include fluororesin (for example, polytetrafluoroethylene), polyimide resin (PI), polyamide resin (PA), polyethylene terephthalate (PET), polyethylene naphthalate (PEN), polyphenylene sulfide (PPS), and polybutylene terephthalate (PBT). More preferably, a porous resin is used. Porous resins have a heat conductivity lower than that of metal, and an excellent heat insulation performance by many pores formed therein.

Preferable examples of the metal include stainless steel and aluminum. These materials are free from corrosion or deformation caused by aging deterioration, and have excellent reliability. Specifically, the oil flow suppressing member 50 can be produced by press-molding a steel material or an aluminum material. Considering the fact that the press molding is a method that provides an excellent productivity, and that the above-mentioned materials are easy to process and inexpensive, it is a wise idea to produce the oil flow suppressing member 50 from metal.

Preferable examples of the ceramic include those used for various industrial products, such as alumina ceramic, silicon nitride ceramic, and aluminum nitride ceramic. Although ceramics of this kind are thought to be inferior to resins and metal in formability, they are recommended materials from the viewpoints of durability and heat insulation properties. Generally, ceramics have a heat conductivity lower than that of metal. Accordingly, it also may be considered to produce the oil flow suppressing member 50 from ceramic when durability and heat insulation properties are thought as important.

Figure 8:
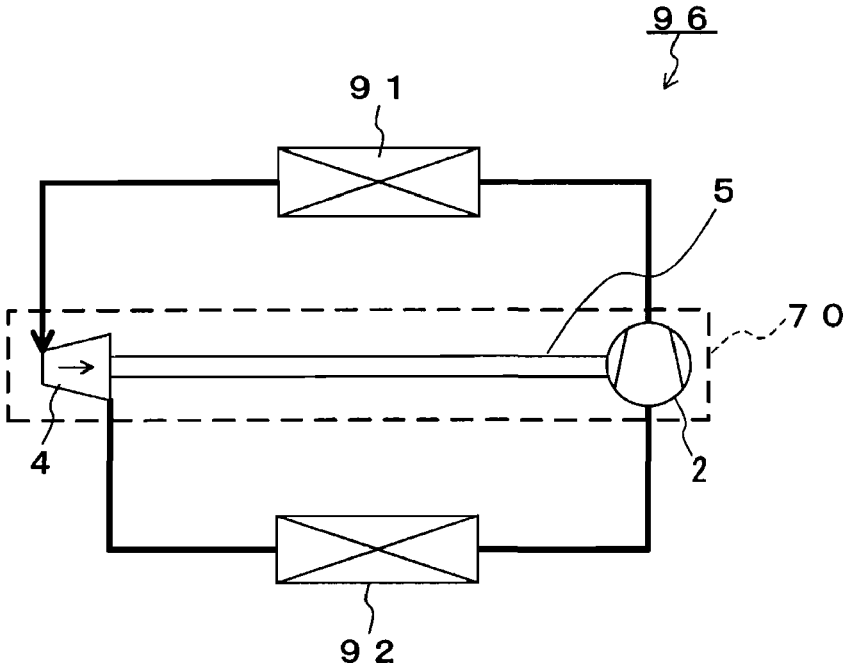
FIG. 8 is a block diagram of a refrigeration cycle apparatus using the expander-compressor unit of the present invention.

FIG. 8 shows a refrigeration cycle apparatus using the expander-compressor unit of the present embodiment. A refrigeration cycle apparatus 96 includes the expander-compressor unit 70, a radiator 91, and an evaporator 92. When the refrigeration cycle apparatus 96 is operated, the temperature of the compression mechanism 2 rises in accordance with the temperature of the refrigerant in a compression process, while the temperature of the expansion mechanism 4 lowers in accordance with the temperature of the refrigerant in an expansion process. Since the interior of the closed casing 1 is filled with the high temperature refrigerant discharged from the compression mechanism 2, the temperature of the oil 60 held in the oil reservoir 6 also rises accordingly.

However, since the inner reserving space 55*a* is separated from the outer reserving space 55*b* by the oil flow suppressing member 50, the oil 60 filling the inner reserving space 55*a* is cooled by the expansion mechanism 4 and the temperature thereof is lowered. Since the oil 60 with the lowered temperature has a density higher than that of the high temperature oil 60 filling the outer reserving space 55*b*, it starts accumulating from the bottom portion 51 of the oil flow suppressing member 50. Eventually, a major portion of the oil 60 in the inner reserving space 55*a* has a lower temperature.

That is, the oil flow suppressing member 50 allows the oil 60 filling the surrounding space of the expansion mechanism 4 to have a lower temperature by preventing it from being mixed with the high temperature oil 60 filling the outer reserving space 55*b*, and thereby it is possible to prevent the expansion mechanism 4 from being heated by the oil 60. As a result, an increase in enthalpy of the refrigerant discharged from the expansion mechanism 4 is suppressed, enhancing the refrigerating capacity of the refrigeration cycle apparatus 96 using the expander-compressor unit 70. Moreover, since the oil 60 in the inner reserving space 55*a* cooled by the expansion mechanism 4 is not easily mixed with the oil 60 in the outer reserving space 55*b*, the oil 60 in the outer reserving space 55*b* is maintained at a relatively high temperature, making it possible to prevent the compression mechanism 2 to be lubricated with this high temperature oil 60 from being cooled. As a result, a decrease in enthalpy of the refrigerant discharged from the compression mechanism 2 is suppressed, enhancing the heating capacity of the refrigeration cycle apparatus 96 using the expander-compressor unit 70.

Second Embodiment

Figure 6:
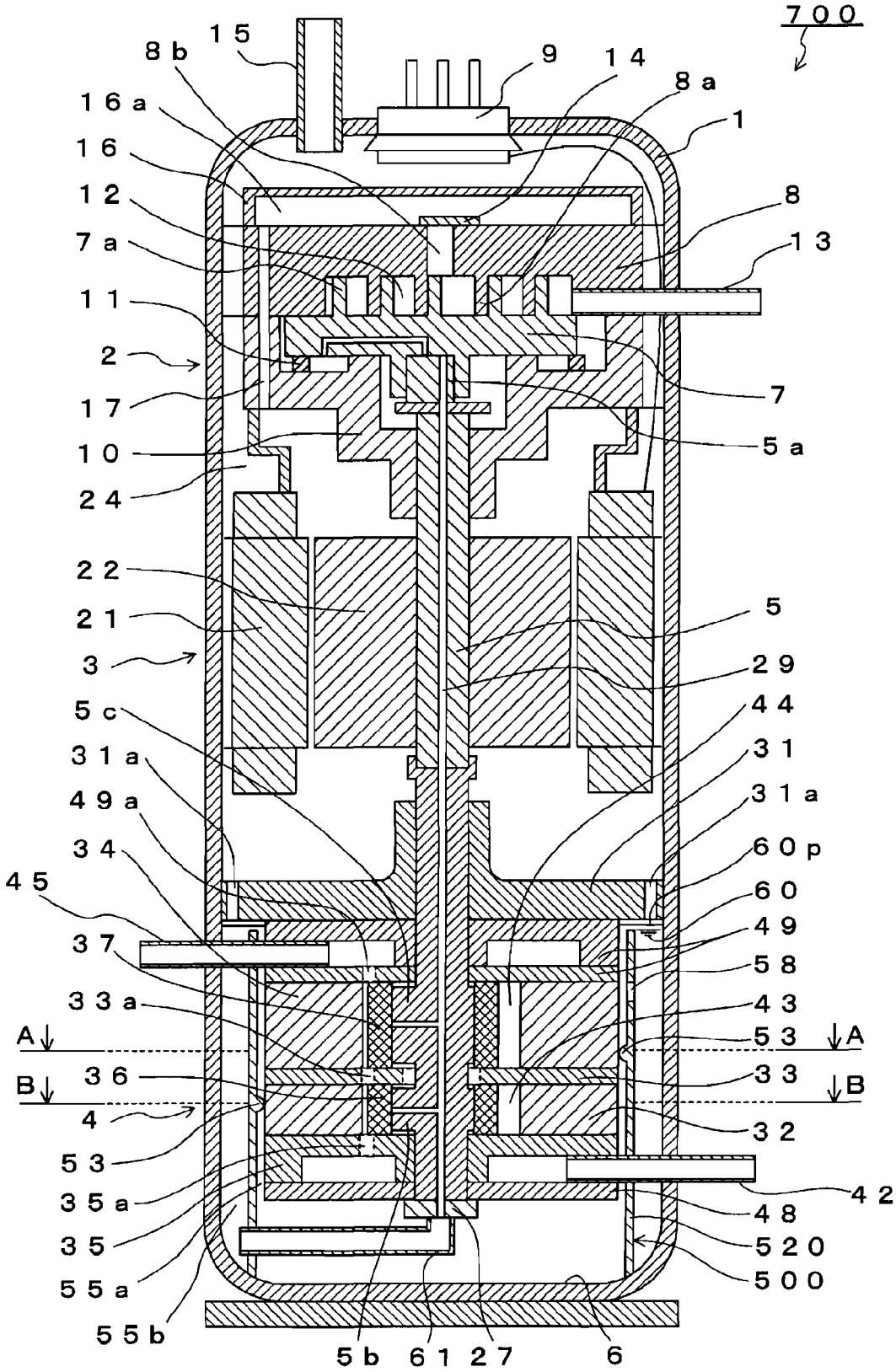
FIG. 6 is a vertical cross-sectional view of an expander-compressor unit according to a second embodiment.

As mentioned above, the oil flow suppressing member for suppressing the flow of the oil filling the surrounding space of the expansion mechanism 4 does not necessarily have to have a bottom portion. An expander-compressor unit 700 shown in FIG. 6 is provided with an oil flow suppressing member 500 substantially constituted by a tubular portion 520 and spacer portions 53 only. A lower end of the tubular portion 520 is in contact with the bottom portion of the closed casing 1 without any clearance therebetween. In short, the tubular portion 520 is fixed to the bottom portion of the closed casing 1, so the oil 60 cannot flow under the tubular portion 520.

In the present embodiment, the lower end of the shaft 5 is exposed to the inner reserving space 55*a*. Thus, an oil supply pipe 61 connecting the oil pump 27 to the outer reserving space 55*b* is provided so that the oil 60 filling the outer reserving space 55*b* can be drawn into the oil pump 27 attached to the lower end portion of the shaft 5. Thereby, the flow of the oil 60 filling the inner reserving space 55*a* is suppressed as in the first embodiment.

Third Embodiment

Figure 7:
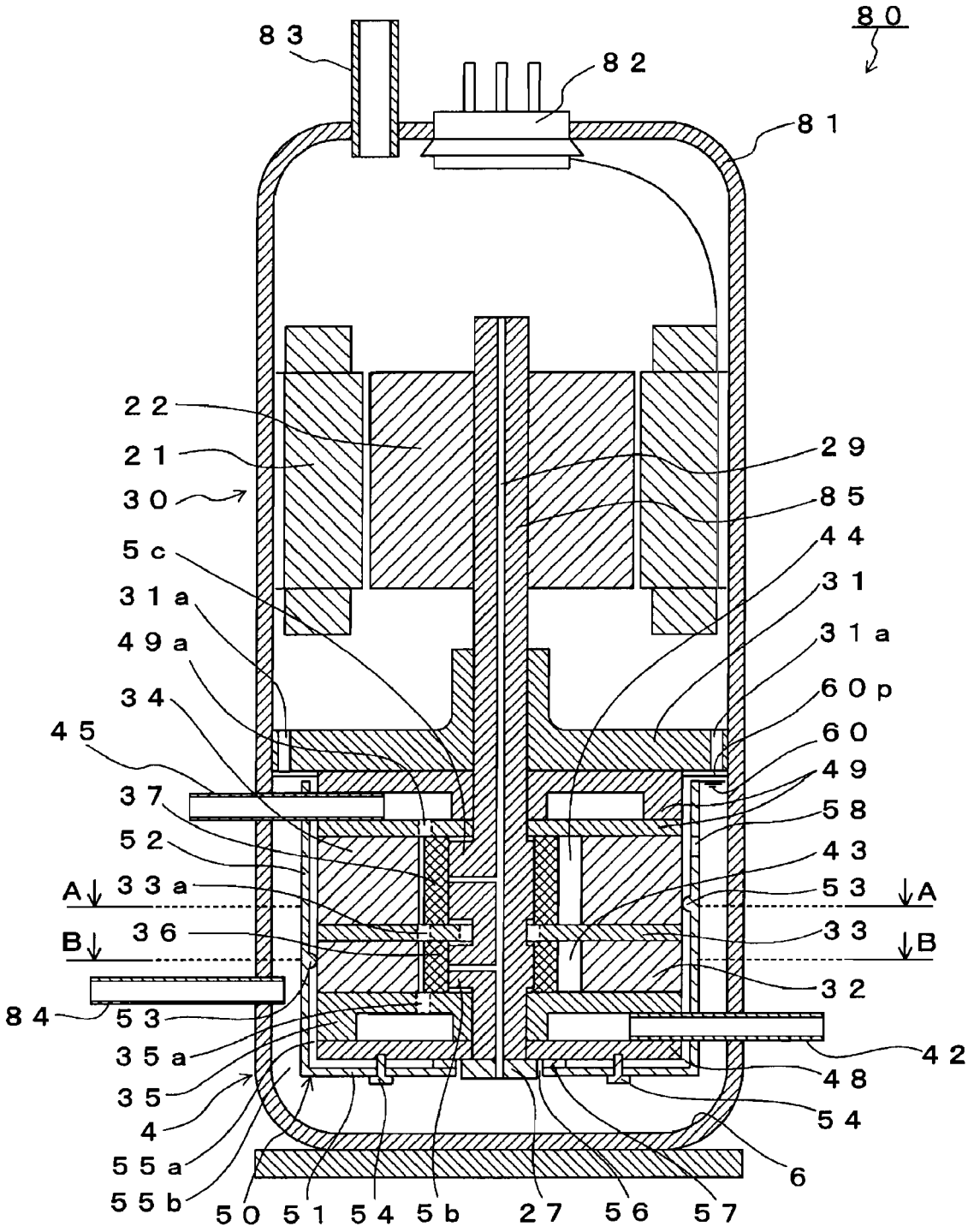
FIG. 7 is a vertical cross-sectional view of an expander according to a third embodiment of the present invention.

The first embodiment describes an example in which the expander-compressor unit 70 includes the expansion mechanism 4 with the oil flow suppressing member 50 attached thereto. The same configuration also can be employed for an independent expander. An expander 80 of the present embodiment shown in FIG. 7 includes a closed casing 81, an electric generator 30 disposed in the closed casing 81, and the expansion mechanism 4 coupled to the electric generator 30 by a shaft 85. The expansion mechanism 4 is disposed in the closed casing 81 in such a manner that a surrounding space thereof is filled with oil. The oil flow suppressing member 50 is attached to the expansion mechanism 4. The configurations of the expansion mechanism 4 and the oil flow suppressing member 50 are the same as those in the first embodiment. The expansion energy generated during the expansion of the refrigerant is recovered by the expansion mechanism 4, and then is converted into electric power by the electric generator 30. The electric power generated by the electric generator 30 can be taken out from the closed casing 81 through a terminal 82. The oil flow suppressing member 50 attached to the expansion mechanism 4 prevents the expansion mechanism 4 from being heated by the high temperature oil 60. These effects are as described in the first embodiment.

Figure 9:
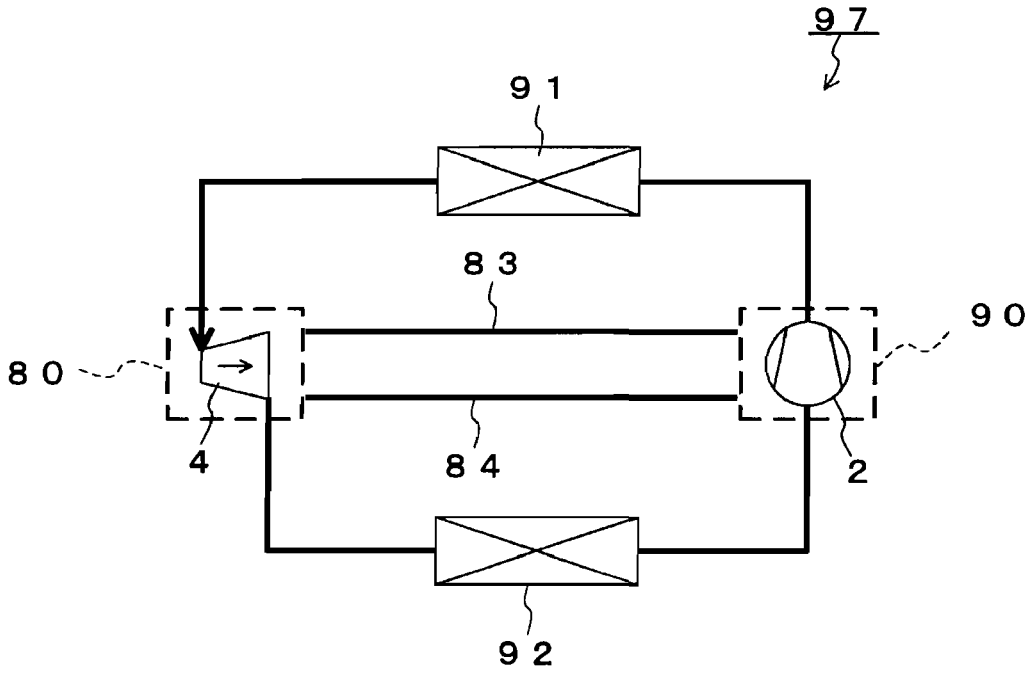
FIG. 9 is a block diagram of a refrigeration cycle apparatus using the expander of the present invention.

FIG. 9 shows a refrigeration cycle apparatus using the expander of the present embodiment. A refrigeration cycle apparatus 97 includes a compressor 90, the radiator 91, the expander 80, and the evaporator 92. The compressor 90 and the expander 80 have a dedicated closed casing, respectively.

It is known that the oil is mixed to the refrigerant in general refrigeration cycle apparatuses. The amount of the oil mixed to the refrigerant at the compression mechanism 2 is not always the same as the amount of the oil mixed to the refrigerant at the expansion mechanism 4. In the refrigeration cycle apparatus 96 using the expander-compressor unit 70 of the first embodiment, the compression mechanism 2 and the expansion mechanism 4 share the same oil. Thus, it is not necessary to consider the balance of the oil.

On the other hand, when the compressor 90 and the expander 80 are provided independently as in the refrigeration cycle apparatus 97 shown in FIG. 9, the balance of the oil need to be considered. Specifically, the compressor 90 and expander 80 are connected to each other by an oil equalizing pipe 84 in order to balance the amount of oil in the compressor 90 with the amount of oil in the expander 80. The oil equalizing pipe 84 is attached to the compressor 90 and the expander 80 in such a manner that one end thereof opens into the oil reservoir 6 (see FIG. 7) of the closed casing 81 of the expander 80 and another end opens into an oil reservoir (now shown) of the closed casing of the compressor 90. Furthermore, from the viewpoint of stabilizing oil levels in the compressor 90 and the expander 80, it is desirable to connect the compressor 90 with the expander 80 by a pressure equalizing pipe 83 so that an atmosphere in the compressor 90 becomes equal to an atmosphere in the expander 80.

As described above, the expander-compressor unit and the expander of the present invention suitably may be applied to refrigeration cycle apparatuses used for, for example, air conditioners, water heaters, various dryers, and refrigerator-freezers.

The invention claimed is:

1. An expander comprising:

a closed casing having a bottom portion utilized as an oil reservoir;

an expansion mechanism disposed in the closed casing in such a manner that a surrounding space thereof is filled with oil; and an oil flow suppressing member that is disposed in the surrounding space of the expansion mechanism and divides an oil reserving space between the closed casing and the expansion mechanism into an inner reserving space and an outer reserving space for suppressing a flow of the oil filling the inner reserving space more strongly than a flow of the oil filling the outer reserving space, the inner reserving space being a space between the oil flow suppressing member and the expansion mechanism and the outer reserving space being a space between the oil flow suppressing member and the closed casing, wherein the oil flow suppressing member includes: a tubular portion that surrounds the expansion mechanism;

a bottom portion that closes an underside of the tubular portion; and assuming that a direction parallel to an axial direction of the shaft is defined as a vertical direction; the oil is allowed to flow into the inner reserving space through a clearance positioned higher than an upper end of the tubular portion.

2. An expander-compressor unit comprising:

a closed casing having a bottom portion utilized as an oil reservoir;

an expansion mechanism disposed in the closed casing in such a manner that a surrounding space thereof is filled with oil;

a compression mechanism disposed in the closed casing in such a manner that the compression mechanism is positioned higher than an oil level;

a shaft for coupling the compression mechanism and the expansion mechanism to each other; and an oil flow suppressing member that is disposed in the surrounding space of the expansion mechanism and divides an oil reserving space between the closed casing and the expansion mechanism into an inner reserving space and an outer reserving space for suppressing a flow of the oil filling the inner reserving space more strongly than a flow of the oil filling the outer reserving space, the inner reserving space being a space between the oil flow suppressing member and the expansion mechanism and the outer reserving space being a space between the oil flow suppressing member and the closed casing, wherein the oil flow suppressing member includes: a tubular portion that surrounds the expansion mechanism;

a bottom portion that closes an underside of the tubular portion; and assuming that a direction parallel to an axial direction of the shaft is defined as a vertical direction; the oil is allowed to flow into the inner reserving space through a clearance positioned higher than an upper end of the tubular portion.

3. The expander-compressor unit according to claim 2, further comprising an oil return passage for returning, to the outer reserving space, the oil that has been supplied from the outer reserving space to the compression mechanism through an oil supply passage formed in the shaft and has been used for lubricating the compression mechanism, using a self weight of the oil.

4. The expander-compressor unit according to claim 3, further comprising a motor that is disposed between the expansion mechanism and the compression mechanism and drives the shaft rotationally, wherein the oil return passages are formed between the motor and the expansion mechanism in the closed casing while being open toward the outer reserving space.

5. The expander-compressor unit according to claim 2, wherein the tubular portion has a shape extending along an outline of the expansion mechanism.

6. The expander-compressor unit according to claim 2, wherein the shape, a size, and a mounting location of the tubular portion are determined in such a manner that the oil filling the inner reserving space has a volume smaller than a volume of the oil filling the outer reserving space.

7. The expander-compressor unit according to claim 2, wherein the oil flow suppressing member includes a closed-bottomed tubular vessel with a shape extending along the outline of the expansion mechanism, and the tubular portion forms a part of the vessel.

8. The expander-compressor unit according to claim 7, wherein the closed-bottomed tubular vessel is composed of resin.

9. The expander-compressor unit according to claim 7, wherein the closed-bottomed tubular vessel is composed of metal.

10. The expander-compressor unit according to claim 7, wherein the closed-bottomed tubular vessel is composed of ceramic.

11. The expander-compressor unit according to claim 7, wherein the closed-bottomed tubular vessel includes a structure for improving heat insulation properties.

12. The expander-compressor unit according to claim 11, wherein the structure for improving heat insulation properties is a hollow heat insulating structure.

13. The expander-compressor unit according to claim 2, wherein:

an oil supply passage for supplying the oil to the compression mechanism is formed in the shaft in such a manner that the oil supply passage extends in the axial direction;

a through hole is formed in the bottom portion;

the oil filling the outer reserving space is fed into the oil supply passage from a lower end portion of the shaft via the through hole; and a flow of the oil between the inner reserving space and the outer reserving space via the through hole is forbidden by sealing a clearance between the bottom portion and the expansion mechanism in a surrounding space of the through hole.

14. The expander-compressor unit according to claim 2, wherein the oil flow suppressing member further includes a spacer portion that ensures the inner reserving space by preventing the tubular portion from contacting closely with the expansion mechanism.

15. The expander-compressor unit according to claim 14, wherein the spacer portion has a tip portion on a side contacting the expansion mechanism and a base-side portion on a side opposite to the side contacting the expansion mechanism, and the tip portion is narrower than the base-side portion.

16. The expander-compressor unit according to claim 2, further comprising a motor that is disposed between the compression mechanism and the expansion mechanism and drives the shaft rotationally, wherein:

the compression mechanism is a scroll-type mechanism while the expansion mechanism is a rotary-type mechanism; and the compression mechanism, the motor, and the expansion mechanism are disposed in this order along the axial direction of the shaft in such a manner that the surrounding space of the expansion mechanism is filled with the oil.

* * * * *